US007290307B1

(12) United States Patent
Chao

(10) Patent No.: US 7,290,307 B1
(45) Date of Patent: Nov. 6, 2007

(54) IMPLEMENT FOR REMOVING PAVEMENT CLEANER

(76) Inventor: Victor Chao, P.O. Box 50001, Bellevue, WA (US) 98015

( * ) Notice: Subject to any disclaimer, the term of this patent is extended or adjusted under 35 U.S.C. 154(b) by 547 days.

(21) Appl. No.: 10/855,240

(22) Filed: May 27, 2004

(51) Int. Cl.
*E01H 1/08* (2006.01)

(52) U.S. Cl. ..... 15/322; 15/340.1; 15/353

(58) Field of Classification Search ..... 15/320, 15/321, 322, 340.1, 353
See application file for complete search history.

(56) References Cited

U.S. PATENT DOCUMENTS

| | | | | | |
|---|---|---|---|---|---|
| 3,705,437 | A * | 12/1972 | Rukavina et al. | ..... | 15/321 |
| 3,840,935 | A * | 10/1974 | Fitzgerald et al. | ..... | 15/322 |
| 4,282,626 | A * | 8/1981 | Schneider | ..... | 15/320 |
| 5,224,236 | A * | 7/1993 | Sallquist | ..... | 15/321 |
| 5,555,598 | A * | 9/1996 | Grave et al. | ..... | 15/322 |
| 5,589,080 | A * | 12/1996 | Cho et al. | ..... | 15/320 |
| 5,826,298 | A * | 10/1998 | Rohrbacher et al. | ..... | 15/321 |
| 6,360,396 | B1 | 3/2002 | Chao | | |
| 6,598,262 | B2 * | 7/2003 | Farina | ..... | 15/321 |
| 6,896,742 | B2 * | 5/2005 | Geyer et al. | ..... | 15/320 |

* cited by examiner

*Primary Examiner*—Theresa T. Snider
(74) *Attorney, Agent, or Firm*—David L. Tingey

(57) ABSTRACT

A pavement cleaning vehicle includes a tow vehicle and a trailer towed behind the tow vehicle that includes a vacuum head mounted to the trailer that consumes fresh water from a fresh water holding tank on the tow vehicle in rinsing underlying pavement. Pressurized fresh water is sprayed within a spray containing spray chamber of a vacuum head through nozzles aligned transversely across the vehicle travel path. The vacuum chamber is partitioned in the vacuum head from the spray chamber by a divider extending downward but terminating short of the underlying pavement therein establishing a chamber gap through which rinse water within the spray chamber dispersed from the pavement is drawn into the vacuum chamber which is maintained at reduced air pressure by an air-water separator tank that draws air and water mix from the vacuum head into it for air-water separation. Water is then conducted to a rinse water holding tank and air is exhausted to atmosphere. During operation the vacuum head is supported rearward of the trailer on support wheels maintaining the vacuum head in close proximity to the pavement. The vacuum head is lifted off the pavement surface for general travel with the trailer during non-operational periods by a lift line routed through a boom extending rearward over the vacuum head from the trailer.

19 Claims, 4 Drawing Sheets

IMPLEMENT FOR REMOVING PAVEMENT CLEANER

BACKGROUND OF THE INVENTION

1. Field of the Invention

This invention relates to vehicles and implements for cleaning asphalt or concrete or other like pavement, and particularly, to an implement for removing cleaning solutions from pavement during a pavement scrubbing process, which implement is typically towed behind a towing vehicle.

2. Prior Art

Independently-motored street sweepers are well-known. Likewise, various plows and sweepers mountable forward of a drive vehicle are known as are sweeper attachments mounted rearward of a drive vehicle. These sweepers comprise long bristle brushes adjusted to slightly contact a street surface so as to minimize brush wear yet still impel street litter into a collection mechanism. In a prior patent (U.S. Pat. No. 6,360,396) this applicant describes a rotating brush tractor implement removably towable behind a tractor that has substantially nonpliable brush bristles sufficient to scrub a street or runway surface to remove materials adhering to pavement, typically of asphalt or concrete, such as tire rubber as opposed to only materials generally loose on the surface.

In the scrubbing process it is common to employ a cleaning solution, including sudsy water, to help release grease, oil, rubber deposit and grime from pavement, acting in concert with the rotating scrubber brushes. However, after the scrubbing process, the solvent and a portion of the loosened or released grease, oil, rubber deposit and grime remains on the pavement. It is the primary object of the present invention to provide a towable implement that washes, or rinses the solvent from the pavement with fresh water and removes the solvent, rinse water and remaining grease, oil and grime from the pavement into a container transported away on the tow vehicle.

SUMMARY

This and other objects are achieved in a pavement cleaning vehicle for cleaning a runway, asphalt, concrete or other large pavement advantageously comprising a tow vehicle and a trailer towed behind the tow vehicle that includes a vacuum head mounted to the trailer that consumes fresh water in rinsing underlying pavement. A fresh water holding tank that supplies water to the vacuum head is mounted on the tow vehicle rather than the trailer so it can be alternately pulled by different tow vehicles to keep the trailer operating to clean pavement. As one fresh water holding tank is consumed, it is replaced with another full one on another tow vehicle simply by disengaging the trailer from a first tow vehicle and hitch it to the second tow vehicle and changing the water connection to the trailer.

This configuration offers the capability of capturing liquid debris while the tow vehicle and trailer move continuously forward so a large paved area can be serviced in a relatively short time.

The vacuum head is divided into a nozzle chamber and a vacuum chamber rearward of the nozzle chamber. Reduced air pressure is maintained in the vacuum chamber during operation by action of a vacuum motor on the trailer. Water is drawn from a fresh water holding tank on the tow vehicle through a pressure washer and to a series of nozzles in the nozzle chamber aligned transverse to the vehicle motion. The nozzles are directed generally downward at the underlying pavement on which the pavement-cleaning implement rides in a high pressure flow that dislodges and removes grease, oil, rubber deposit and grime from the pavement surface and then suspends or dissolves it in the water. As the vacuum head is drawn forward the vacuum chamber passes over the area previously addressed by the nozzle chamber and the water with the removed matter is drawn into the vacuum chamber due to reduced pressure therein.

The vacuum head is supported in operation on support wheels in close proximity to the pavement during cleaning operation and is lifted off the pavement surface for general travel with the trailer during non-operational periods by a lift line routed through a boom extending rearward over the vacuum head from the trailer.

BRIEF DESCRIPTION OF THE DRAWINGS

As illustrated in FIG. 5 and shown schematically in FIG. 4, the pavement-cleaning implement of the present invention includes an automobile suitable for normal roadway operation and for towing, for all purposes herein referred to as a tow vehicle or a motor vehicle 10, a trailer separate from and towed by the motor vehicle, for all purposes herein referred to as a towed trailer 12 and a vacuum head 14 behind and separate from the motor vehicle 10 and the towed trailer 12 and towed behind the towed trailer 12. A fresh water holding tank 16 and a rinse water holding tank 18 are carried on the tow vehicle 10. An air-water separator 20 with a vacuum blower 21, a particle filter 22, a pressure washer 25 and a water pump 26 disposed to pump water from the air-water separator 20 to the rinse water holding tank 18 are transported on the trailer 12 towed behind the tow vehicle 10. In operational mode the vacuum head 14 is lowered from a boom 27 extending rearward from the trailer 12, itself supported by left and right braces 28. A boom line 29 typically on a power reel passes along the boom 27 and then down to the vacuum head 14 and lifts the vacuum head 14 independently and separate from the towed trailer by line reeling or unreeling action for general non-operational transport and lowers the vacuum head 14 onto support wheels 30 mounted on the vacuum head 14. Typically, wheels 30 on extension legs 34 support the vacuum head 14 fore and aft of the vacuum head 14 on both left and right sides giving the vacuum head 14 stable and uniform support a measured distance from the underlying pavement 100, maintaining containment of dispersed water spray within the vacuum head 14.

Figure 1:
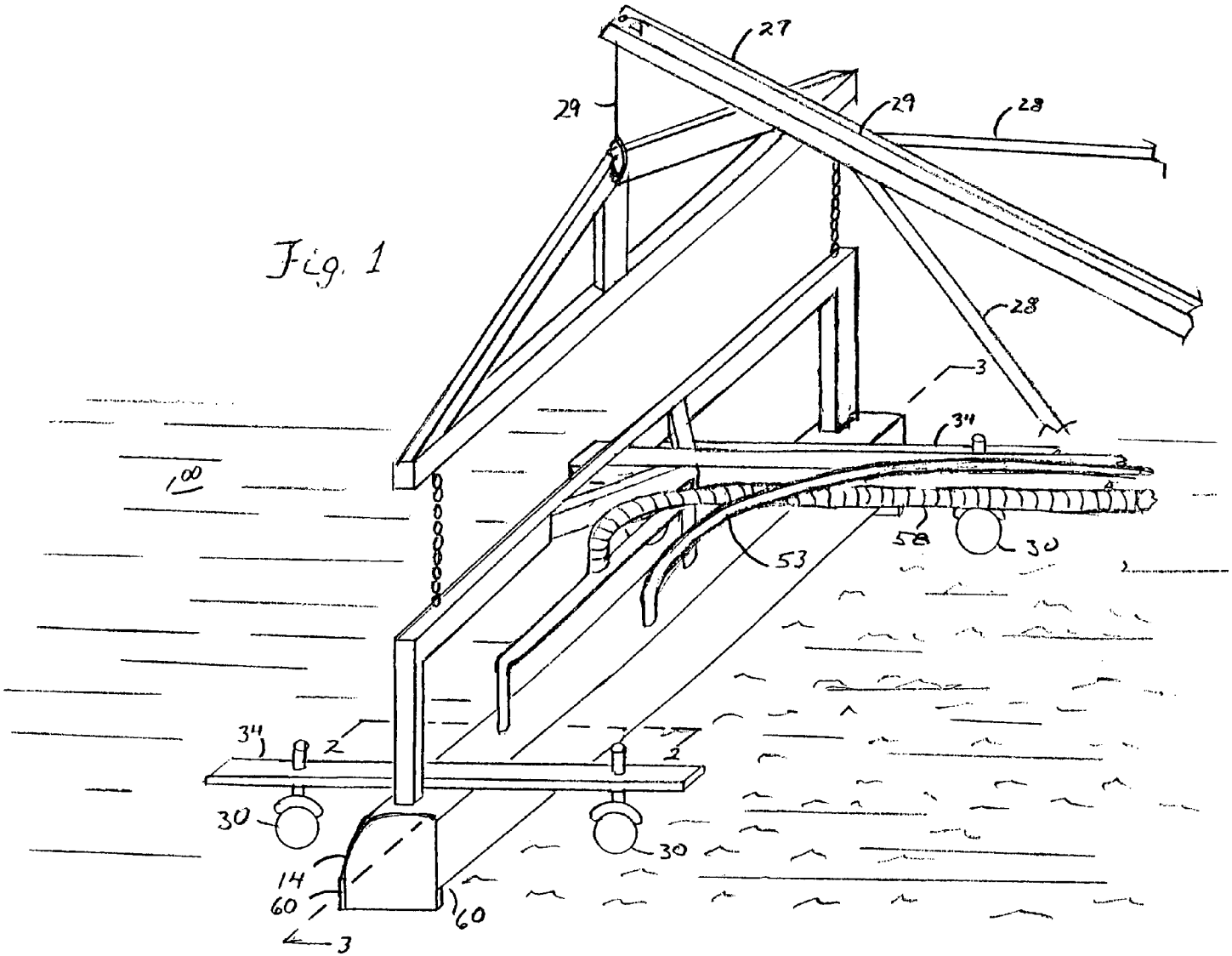
FIG. 1 is a perspective view of the vacuum head of the present invention.
Figure 2:
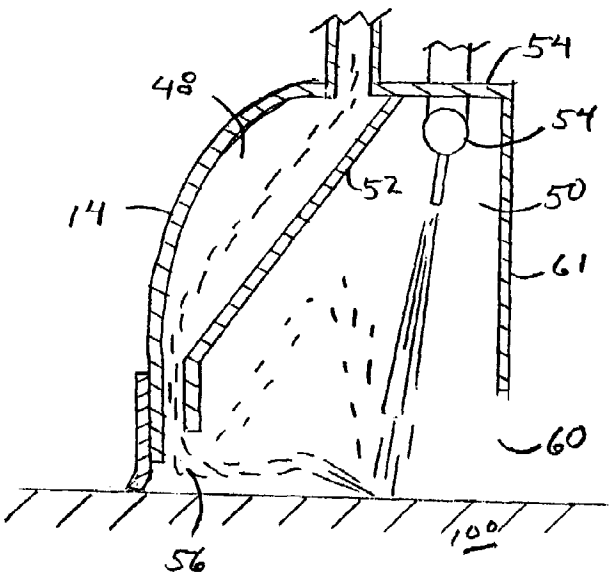
FIG. 2 is a cross-sectional end view of the vacuum head.
Figure 3:
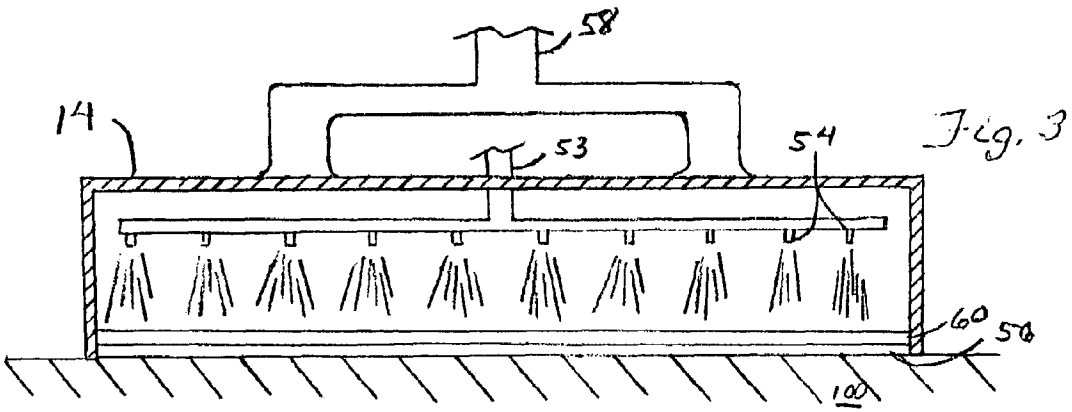
FIG. 3 is a cross-sectional front view of the vacuum head.
Figure 4:
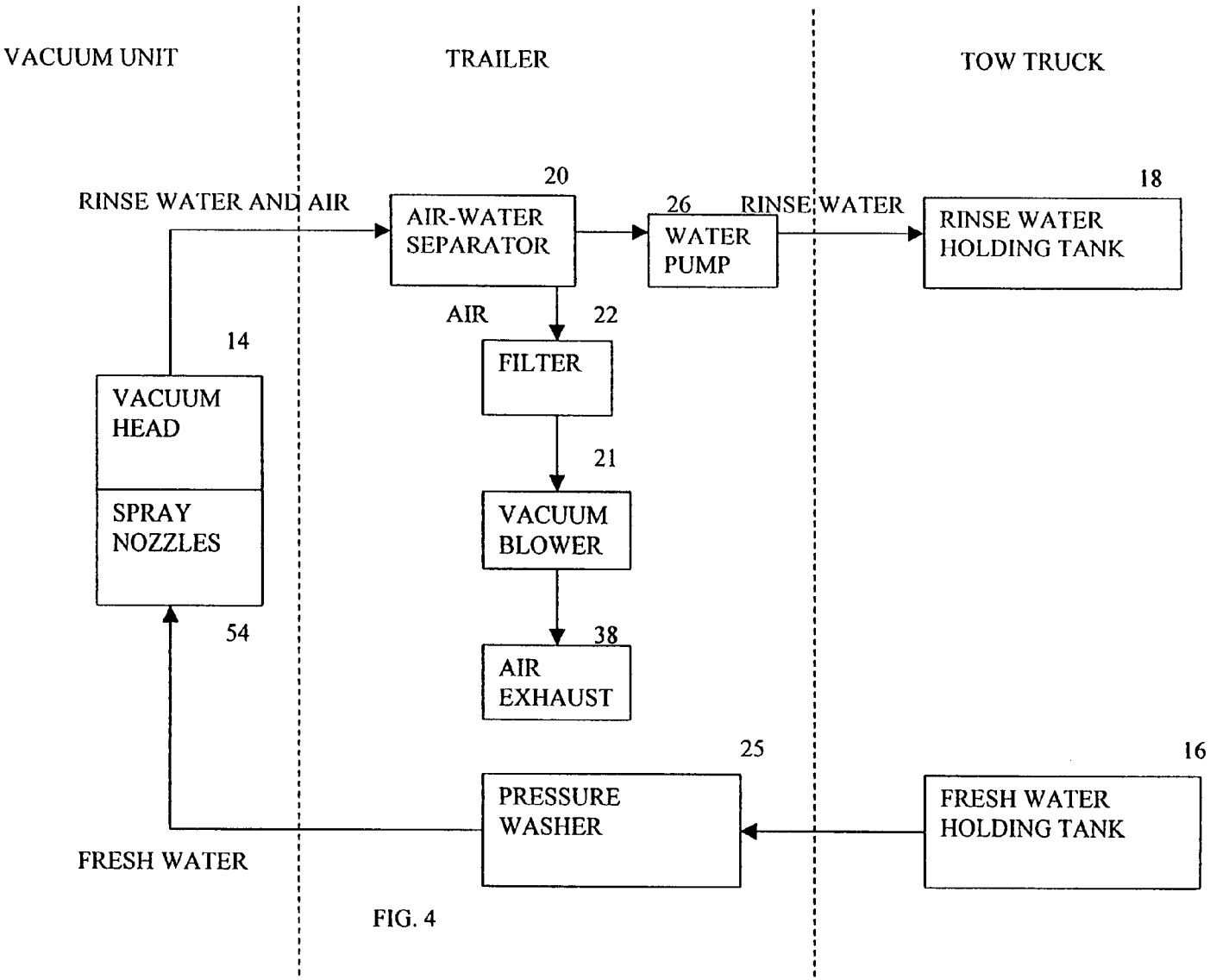
FIG. 4 is diagram of the pavement cleaning implement including components on the vacuum head, the trailer, and the towing vehicle.
Figure 5:
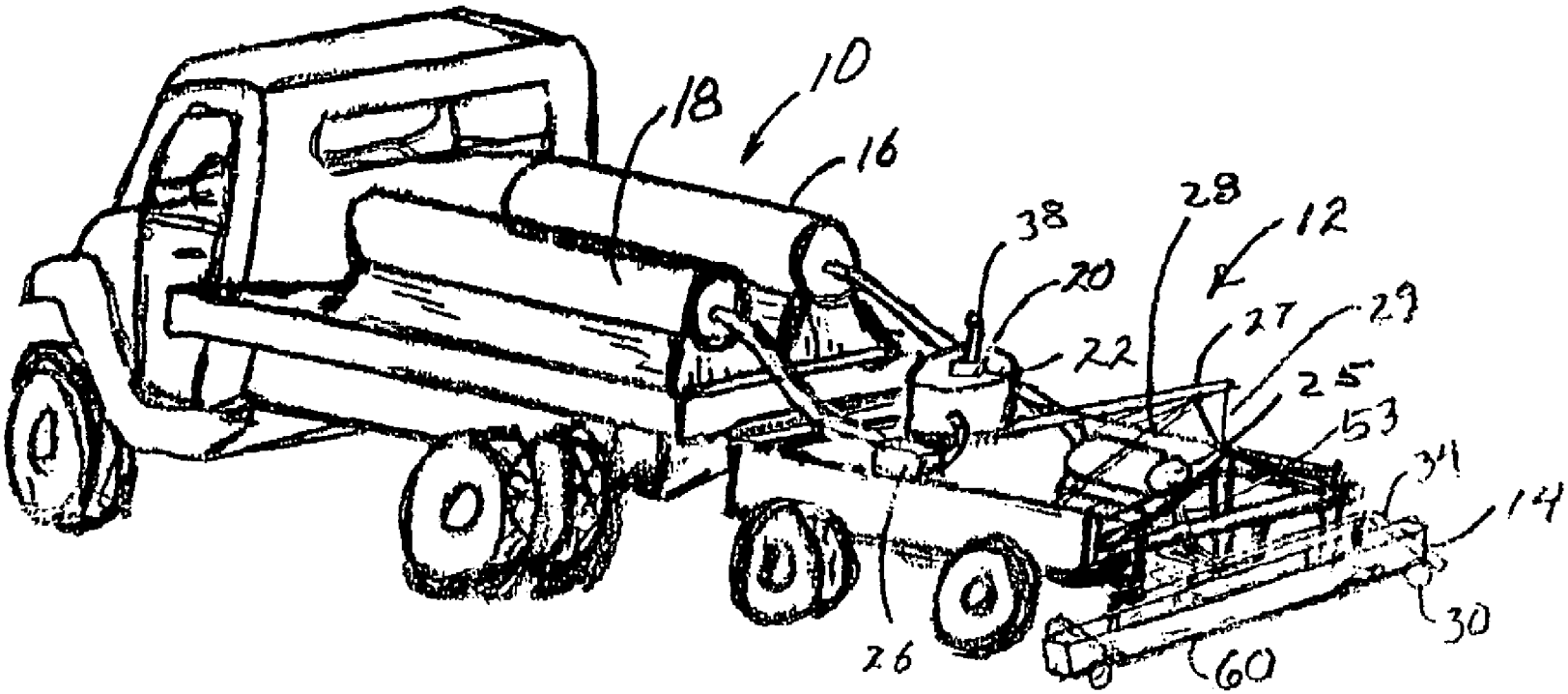
FIG. 5 is a pictorial view of the towing vehicle, trailer, and vacuum head.

The air-water separator 20 with vacuum motor draws air from the vacuum head 14 into the air-water separator 20 then the water filter 22 and then out an exhaust 38. The pressure washer 25 connected between the towed vacuum and the fresh water tank 16 is also mounted with the air-water separator tank on the trailer 12

The vacuum head 14 is divided into a vacuum chamber 48 and a spray chamber 50 by a chamber divider 52. A fresh water conduit 53 connects through the vacuum head 14 from the pressure washer 25 to a plurality of spray nozzles 54 arrayed in transverse alignment within the elongate vacuum head 14 extending across the path of the tow vehicle 10 such that the spray nozzles 54 directed substantially downward, or about 10 degrees rearward, collectively wash the tow vehicle path, or a portion thereof, as the vacuum head 14 is towed behind with rinse water dispersed from the underlying pavement is directed rearward toward the vacuum chamber. For convenience two or more vacuum heads equivalently may be set end to end together to extend across the tow vehicle path, which is deemed included in this disclosure. For ease of description, the vacuum head or two or more vacuum heads end to end will be described as a single vacuum head but in doing so it should be understood that the function of the single vacuum head can be achieved by two or more vacuum heads end to end or overlapping across the tow vehicle path, which for these purposes is meant to be included as an equivalent embodiment.

The divider 52 extends from the vacuum head top 54 slightly rearward as it extends downward to a position slightly above contact with the underlying pavement when the vacuum head is lowered onto its wheels for operation leaving a transverse chamber gap 56 across the elongate vacuum head of approximately ¼ to ½ inch through which water spray from the spray nozzles 54 that has dispersed off the underlying pavement and filled the spray chamber 50 is drawn through the chamber gap 56 (The divider separation from underlying pavement may be adjustable by installation of an adjustable plate on its distal end, which may be of rubber). The water spray is drawn through the chamber gap 56 into the vacuum chamber 48 due to the reduced pressure in the vacuum chamber 48. The air-water separator 20 draws air from the vacuum chamber 48 through the vacuum head 14 by an air conduit 58 connected into between the vacuum motor 40 and the vacuum chamber 48. A spray chamber gap 60 provides an opening through which air passes from atmosphere into the spray chamber 50 thus maintaining a continuous airflow through the vacuum head that carries rinse water to the air-water separator 20. Typically, the spray chamber gap 60 is formed from a vacuum head forward panel 61 extending downward and terminating spaced apart from the underlying pavement 100 forming the spray chamber gap 60. A rubber seal 62 extends rearward along the vacuum head 14 closing that measured distance between the vacuum head 14 and the underlying pavement 100 so air water mix does not escape from under the vacuum head 14.

In sum, in operation the pressure washer 25 receives fresh water from the fresh water holding tank 16 and pressurizes the water. Pressurized water is then conducted to the spray nozzles 54 where it is jetted onto the underlying pavement 100 to lift pavement grime and cleaning solution into the spray chamber 50. The then dirty rinse water is then drawn through the chamber gap 56 into the vacuum chamber 48 and then into the air-water separator 20 where the air is separated from the water as the water collects by gravity into the tank and the air exits the tank through the particle filter 22 before it is exhausted to atmosphere. The rinse water is then pumped by pump motor 26 from the air-water separator 20 to the rinse water holding tank 18 on the tow vehicle. In an alternate embodiment, the rinse water holding tank also includes the air-water separator as an integral part thereof.

The invention claimed is:

1. A pavement cleaning vehicle configured with equipment to remove grime and cleaning materials from a pavement drive surface, such as a runway or other large pavement of asphalt or concrete, comprising a pressure washer, a vacuum blower, an elongate vacuum head extending transversely behind the pavement cleaning vehicle comprising a spray chamber partitioned from a vacuum chamber by a divider extending with an air passageway therethrough, wherein said pavement cleaning vehicle comprises a motor vehicle suitable for roadway operation and for towing and a trailer towed by the motor vehicle, the vacuum head being behind and separate from and towed by the trailer, wherein the vacuum head is adjustable vertically from underlying pavement independent of the cleaning vehicle, an air-water separator on the trailer separating air from water received from the vacuum head, an array of spray nozzles in fluid communication with the pressure washer and arrayed in close proximity to said pavement within the vacuum head spray chamber in transverse alignment across a travel path of the cleaning vehicle, or a portion thereof, adapted to spray pressurized water jets at the underlying pavement effective in rinsing said grime and cleaning materials from said pavement, lifting them with the water reflected from the pavement the water, grime and cleaning materials being contained within the spray chamber until they are drawn through the air passageway into the vacuum chamber and from the vacuum chamber to the air-water separator, the vacuum chamber having reduced air pressure by action of the vacuum blower in fluid communication therewith, wherein said spray nozzles are connectable to a fresh water holding tank for supplying fresh water to the pressure washer and spray nozzles, water spray dispersed off the underlying pavement being contained within the spray chamber until it is drawn into the vacuum chamber.

2. The pavement cleaning vehicle of claim 1 wherein the spray nozzles are directed substantially downward at the underlying pavement and are also directed slightly rearward such that water dispersed from the pavement is directed generally rearward toward the air passageway.

3. The pavement cleaning vehicle of claim 1 wherein the divider extends from a vacuum head top downward to a position slightly above contact with the underlying pavement leaving a transverse chamber gap across the elongate vacuum head forming the air passageway through which water spray from the spray nozzles is drawn into the vacuum chamber from the spray chamber containing water spray dispersed off the underlying pavement.

4. The pavement cleaning vehicle of claim 1 wherein the vacuum head spray chamber includes a spray chamber gap through which air passes from atmosphere into the spray chamber thus maintaining a continuous air flow through the vacuum head that carries rinse water to the air-water separator.

5. The pavement cleaning vehicle of claim 4 further comprising a vacuum head forward panel extending downward and terminating spaced apart from the underlying pavement forming the spray chamber gap.

6. The pavement cleaning vehicle of claim 1 further comprising a rinse water holding tank in fluid communication with said air-water separator for receiving rinse water from the air-water separator.

7. A pavement cleaning vehicle configured with equipment to remove grime and cleaning materials from a pavement drive surface, such as a runway or other large pavement of asphalt or concrete, comprising a pressure washer, a vacuum blower, an elongate vacuum head extending transversely behind the cleaning vehicle comprising a spray chamber partitioned from a vacuum chamber by a divider extending with an air passageway therethrough, wherein said cleaning vehicle comprises a self-propelled motor vehicle suitable for roadway operation and for towing and a trailer towed by the motor vehicle, the vacuum head behind and separate from and towed by the trailer, wherein the vacuum head is towed by the cleaning vehicle and is adjustable vertically from underlying pavement independent of the cleaning vehicle, an air-water separator on the trailer separating air from water received from the vacuum head, an array of spray nozzles in fluid communication with the pressure washer and arrayed in close proximity to said pavement within the vacuum head spray chamber in transverse alignment across a travel path of the cleaning vehicle, or a portion thereof, adapted to spray pressurized water jets at the underlying pavement effective in rinsing said grime and cleaning materials from said pavement, lifting them with the water reflected from the pavement the water, grime and cleaning materials being contained within the spray chamber until they are drawn through the air passageway into the vacuum chamber and from the vacuum chamber to the air-water separator, the vacuum chamber having reduced air pressure by action of the vacuum blower in fluid communication therewith, wherein said spray nozzles are connectable to a fresh water holding tank for supplying fresh water to the pressure washer and spray nozzles, water spray dispersed off the underlying pavement being contained within the spray chamber until it is drawn into the vacuum chamber, the fresh water holding tank being mounted on said motor vehicle, a rinse water holding tank in fluid communication with said air-water separator for receiving rinse water from the air-water separator, a water pump disposed to pump water from the air-water separator to the rinse water holding tank, said trailer disengageably towed by the motor vehicle on which trailer is mounted the pressure washer, the vacuum blower, water pump and the elongate vacuum head.

8. The pavement cleaning vehicle of claim 7 in which the air-water separator is mounted on the motor vehicle.

9. The pavement cleaning vehicle of claim 7 further comprising said rinse water holding tank on the motor vehicle with the air-water separator in fluid communication therewith, rinse water pumped to the holding tank from the air-water separator and air exhausted to atmosphere.

10. The pavement cleaning vehicle of claim 9 wherein the air-water separator is mounted on the trailer.

11. The pavement cleaning vehicle of claim 7 wherein the vacuum head is supported rearward from the trailer and is moveable between a first, or transport position raised above the pavement suitable for general travel on a roadway during non-operation and a second, or operational position in which the vacuum head is lowered rearward from the trailer onto vacuum head wheels supporting the vacuum head during cleaning operation in close proximity to the pavement.

12. The pavement cleaning vehicle of claim 11 wherein vacuum head wheels comprise wheels on extension legs fore and aft of the vacuum head on both left and right vacuum head sides giving the vacuum head stable and uniform support a close measured distance from the underlying pavement in maintaining containment of dispersed water spray within the spray chamber and in maintaining reduced pressure in the vacuum chamber.

13. The pavement cleaning vehicle of claim 11 further comprising a boom mounted to the trailer with a boom line conducted thereon with the vacuum head supported from said boom line in its transport position and lowered by said boom line into and from its operational position.

14. A pavement cleaning vehicle configured with equipment to remove grime and cleaning materials from a pavement drive surface, such as a runway or other large pavement of asphalt or concrete, comprising a tow vehicle, a fresh water tank mounted on the tow vehicle, a vacuum blower, a pressure washer, a rinse water holding tank on the tow vehicle, a water pump disposed to pump water from an air-water separator to the rinse water holding tank, an elongate vacuum head extending transversely behind the cleaning vehicle comprising a spray chamber partitioned from a vacuum chamber by a divider extending downward from a vacuum head top to a position slightly above contact with the underlying pavement leaving a transverse chamber gap across the elongate vacuum head forming an air passageway through which water spray from a plurality of spray nozzles is drawn into the vacuum chamber from the spray chamber that contains water spray dispersed off the underlying pavement, said air-water separator separating air from water received from the vacuum head, with the air-water separator in fluid communication with the vacuum head vacuum chamber, separated water pumped to the holding tank from the air-water separator and separated air exhausted to atmosphere, said array of spray nozzles being in fluid communication with the pressure washer and arrayed in close proximity to said pavement within the vacuum head spray chamber in transverse alignment across a travel path of the cleaning vehicle, or a portion thereof, adapted to spray pressurized water jets at the underlying pavement effective in rinsing said grime and cleaning materials from said pavement, lifting them with the water reflected from the pavement the water, grime and cleaning materials being contained within the spray chamber until they are drawn through the air passageway into the vacuum chamber and from the vacuum chamber to the air-water separator, the vacuum chamber having reduced air pressure by action of the vacuum blower in fluid communication therewith, wherein said spray nozzles are connectable to said fresh water holding tank for supplying fresh water to the spray nozzles, water spray dispersed off the underlying pavement being contained within the spray chamber until it is drawn into the vacuum chamber, a spray chamber gap in the vacuum head spray chamber through which air passes from atmosphere into the spray chamber thus maintaining a continuous air flow through the vacuum head that carries rinse water to the air-water separator, a trailer disengageably towed by the tow vehicle on which trailer is mounted the pressure washer, the vacuum blower, the water pump, and the elongate vacuum head.

15. The pavement cleaning vehicle of claim 14 wherein the rinse water holding tank comprises the air-water separator.

16. The pavement cleaning vehicle of claim 14 wherein the air-water separator is mounted on the trailer in fluid communication with the rinse water holding tank.

17. The pavement cleaning vehicle of claim 14 wherein the vacuum head is supported rearward from the trailer and is moveable between a first, or transport position raised above the pavement suitable for general travel on a roadway during non-operation and a second, or operational position in which the vacuum head is lowered rearward from the trailer onto vacuum head wheels uniformly supporting the vacuum head during cleaning operation in close proximity to the pavement a close measured distance from the underlying pavement in maintaining containment of dispersed water spray within the spray chamber and in maintaining reduced pressure in the vacuum chamber.

18. The pavement cleaning vehicle of claim 17 further comprising a boom mounted to the trailer with a boom line conducted thereon with the vacuum head supported from said boom line in its transport position and lowered by said boom line into and from its operational position.

19. A pavement cleaning vehicle configured with equipment to remove grime and cleaning materials from a pavement drive surface, such as a runway or other large pavement of asphalt or concrete, comprising a pressure washer, a vacuum blower, an elongate vacuum head extending transversely behind the cleaning vehicle comprising a spray chamber partitioned from a vacuum chamber by a divider extending with an air passageway therethrough, wherein said cleaning vehicle comprises a self-propelled motor vehicle suitable for roadway operation and for towing and a trailer towed by the motor vehicle, the vacuum head behind and separate from and towed by the trailer, wherein the vacuum head is adjustable vertically from underlying pavement independent of the cleaning vehicle, an air-water separator on the trailer separating air from water received from the vacuum head, an array of spray nozzles in fluid communication with the pressure washer and arrayed in close proximity to said pavement within the vacuum head spray chamber in transverse alignment across a travel path of the cleaning vehicle, or a portion thereof, adapted to spray pressurized water jets at the underlying pavement effective in rinsing said grime and cleaning materials from said pavement, lifting them with the water reflected from the pavement the water, grime and cleaning materials being contained within the spray chamber until they are drawn through the air passageway into the vacuum chamber and from the vacuum chamber to the air-water separator, the vacuum chamber having reduced air pressure by action of the vacuum blower in fluid communication therewith, wherein said spray nozzles are connectable to a fresh water holding tank for supplying fresh water to the spray nozzles, water spray dispersed off the underlying pavement being contained within the spray chamber until it is drawn into the vacuum chamber, a boom on which the vacuum head is supported rearward from the trailer with a boom line conducted thereon, the vacuum head moveable by reeling or unreeling action of the boom line between a first, or transport position raised above the pavement suitable for general travel on a roadway during non-operation and a second, or operational position in which the vacuum head is lowered rearward from the trailer onto vacuum head wheels uniformly supporting the vacuum head during cleaning operation in close proximity to the pavement a close measured distance from the underlying pavement in maintaining containment of dispersed water spray within the spray chamber and in maintaining reduced pressure in the vacuum chamber.

* * * * *